US007032264B2

(12) United States Patent
Funatogawa

(10) Patent No.: US 7,032,264 B2
(45) Date of Patent: Apr. 25, 2006

(54) PILLOW HAVING SLOPING PARTITION

(75) Inventor: Hiroyuki Funatogawa, Ashikaga (JP)

(73) Assignee: Kabushiki Kaisha Dokuta Eru, Ashikaga (JP)

( * ) Notice: Subject to any disclaimer, the term of this patent is extended or adjusted under 35 U.S.C. 154(b) by 0 days.

(21) Appl. No.: 11/076,037

(22) Filed: Mar. 10, 2005

(65) Prior Publication Data

US 2005/0217029 A1 Oct. 6, 2005

(30) Foreign Application Priority Data

Mar. 31, 2004 (JP) ..... 2004-102592

(51) Int. Cl.
*A47G 9/10* (2006.01)

(52) U.S. Cl. ..... 5/636; 5/645; 5/490

(58) Field of Classification Search ..... 5/636, 5/645, 490, 502, 482, 413 R
See application file for complete search history.

(56) References Cited

U.S. PATENT DOCUMENTS 3,222,698 A * 12/1965 Levenson ..... 297/452.48
3,753,264 A * 8/1973 Grenier ..... 5/645
3,787,906 A * 1/1974 Hunt ..... 5/413 R
3,805,720 A * 4/1974 Hunt ..... 112/420
3,857,125 A * 12/1974 Hunt ..... 5/413 R
3,959,834 A * 6/1976 Hunt ..... 5/413 R
3,988,791 A * 11/1976 Simon ..... 5/413 R
4,090,269 A * 5/1978 Hunt ..... 5/413 R
4,115,610 A * 9/1978 Wortman ..... 428/102
4,354,281 A * 10/1982 Satoh ..... 5/413 R
4,832,007 A * 5/1989 Davis et al. ..... 250/580
6,754,918 B1 * 6/2004 Lap ..... 5/413 R

FOREIGN PATENT DOCUMENTS

GB 2106780 A * 4/1983
JP 2003-180499 2/2003

* cited by examiner

*Primary Examiner*—Robert G. Santos
(74) *Attorney, Agent, or Firm*—Bacon & Thomas, PLLC

(57) ABSTRACT

There is disclosed a pillow characterized in that a plurality of sections are formed inside the pillow casing by providing a pair of partitions which slope in such a manner as to open upward between the top cloth and the bottom cloth of the pillow casing, so that stuffing materials are filled into the sections.

1 Claim, 6 Drawing Sheets

PILLOW HAVING SLOPING PARTITION

BACKGROUND OF THE INVENTION

1. Field of the Invention

The present invention relates to a pillow having sloping partitions inside its pillow casing, and it was developed mainly with the principal aim of a three-dimensionally sewn pillow in which a plurality of sections are filled with stuffing materials of various kinds.

2. Description of the Related Art

There exist pillows in which the inside of the pillow casing is separated into a plurality of sections, in order to prevent the stuffing materials such as feathers, floss, pipe chips, Japanese cypress chips, cushion materials, and units in which these materials are stuffed in a bag, all of which are filled into the pillow casing, from moving freely inside the pillow casing by the use of the pillow.

In these pillows, there exist a pillow in which a plurality of sections are formed by sewing the top cloth and the bottom cloth directly by using a sewing machine, etc., and a pillow in which a plurality of sections are formed by providing dividing walls at positions facing the top cloth and the bottom cloth as set forth in Patent Reference 1.

The pillow in which the top cloth and the bottom cloth are sewn has a disadvantage of the hollows generated in the portions sewn by threads, the hollows touching the face and the head, which leads to an uncomfortable feeling. In addition, as set forth in Patent Reference 1, even a pillow having a plurality of sections separated by means of a dividing wall had a disadvantage of the dividing wall positioned approximately at the right angle with respect to the top cloth and the bottom cloth, causing the occurrence of unevenness when the head is laid thereon in a case where a plurality of various stuffing materials are used, which leads to sensing of the seam. Further, when units are used as a stuffing material for a plurality of sections, there occurred a disadvantage of the unit stuffing materials being out of position with respect to each other.

[Patent Reference 1] Japanese Unexamined Patent Publication No. 2003-180499

SUMMARY OF THE INVENTION

The present invention aims to solve the above-mentioned disadvantages and to achieve the following objects. Firstly, a pillow which does not generate unevenness due to stuffing materials inside the partitioned sections, and by which the user does not feel the seam should be achieved. Secondly, a pillow with a pile of a plurality of stuffing materials allows the user to experience a sense of use which cannot be created by a single stuffing material. Thirdly, a pillow should be achieved in which the adjacent portions of the stuffing materials inside the intermediate partitioned section are positioned in the upper part of the adjacent portions of the stuffing materials inside the partitioned sections at both sides and press the stuffing materials positioned in the lower part due to the load of the head applied to the pillow, so that the stuffing materials are fixed together firmly even in the case of unit stuffing materials.

The invention relates to a pillow characterized in that a plurality of sections are formed inside the pillow casing by providing in a direction orthogonal to the lengthwise direction of the pillow casing a pair of longitudinal partitions which slope in such a manner as to open upward between the top cloth and the bottom cloth of the pillow casing and providing in a direction orthogonal to the longitudinal partitions a transverse partition which slopes in one direction between the pair of longitudinal partitions, so that stuffing materials are filled into the sections.

In the invention, the partitions are sloping, and thus one adjacent portion of an adjoining stuffing material overlaps with the adjacent portion of the other stuffing material, so that no unevenness due to stuffing materials inside partitioned sections is generated, which has led to a pillow of which users do not feel the seam. Further, a pillow with a pile of a plurality of stuffing materials has also allowed users to experience a sense of use which cannot be created by a single stuffing material. Moreover, the stuffing material inside the intermediate section made by a partition which opens upward is dented as shown in FIG. 5 due to the load of the head applied to the pillow, and thus the adjacent portion of this stuffing material presses the stuffing materials positioned in the lower part since it is positioned in the upper part of the adjacent portion of the stuffing materials inside the partitioned sections in the front and the back or on the left and the right, so that in the case of unit stuffing materials, the unit stuffing materials are fixed together firmly, which has eliminated the risk of being out of position with respect to each other.

Further, the pillow is made into a practical pillow from which one can feel various touch by varying the stuffing materials in the partitioned sections.

BRIFE DESCRIPTION OF THE DRAWINGS

DESCRIPTION OF THE PREFERRED EMBODIMENT

Hereinafter, descriptions are given regarding the embodiments as well as the best mode for carrying out the present invention according to the drawings. FIG. 9 is an overall perspective view showing the appearance of a three-dimensionally sewn pillow according to one embodiment, and this pillow comprises a pillow casing 1 and stuffing materials filled into the pillow casing 1 as shown in FIGS. 3 to 8.

Figure 1:
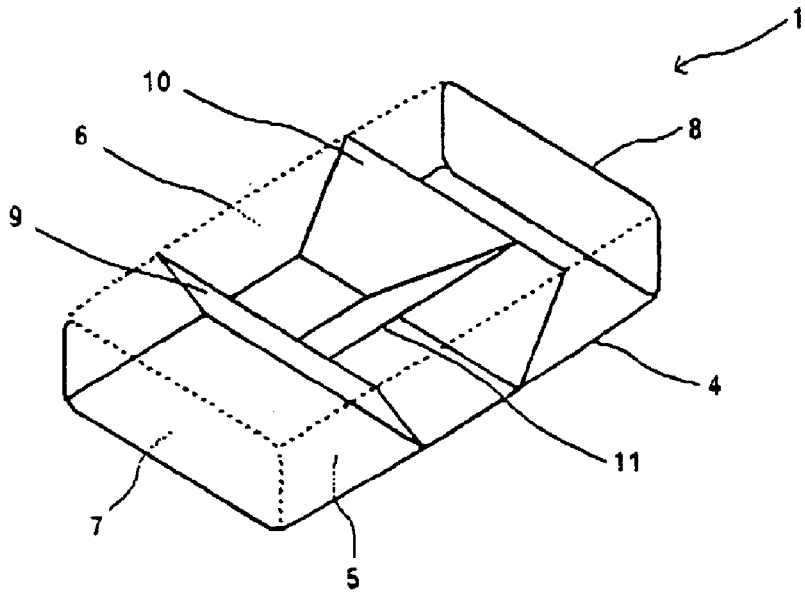
FIG. 1 is an overall perspective view of the pillow casing accordance to one embodiment.
Figure 2:
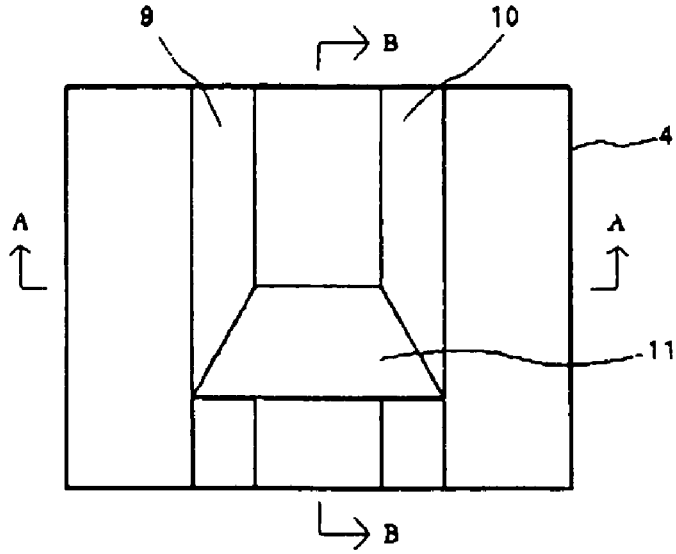
FIG. 2 is a perspective plan view of the above.
Figure 3:
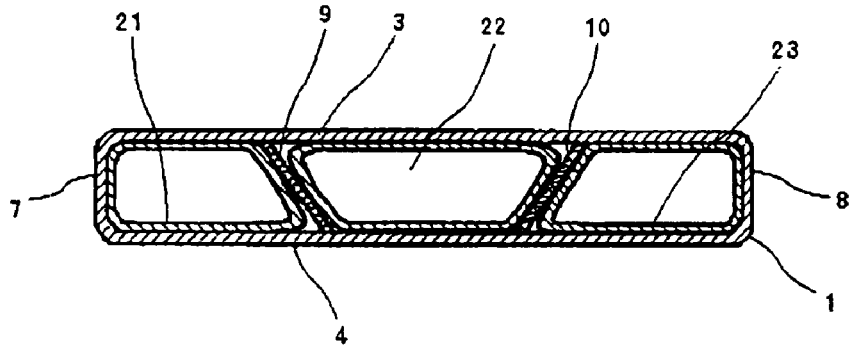
FIG. 3 is a sectional view taken along the line A—A of the pillow.
Figure 4:
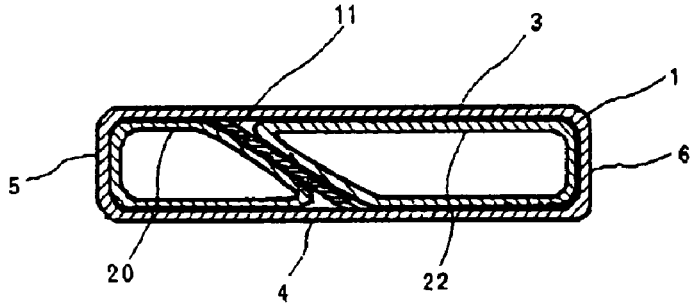
FIG. 4 is a sectional view taken along the line B—B of the pillow.
Figure 5:
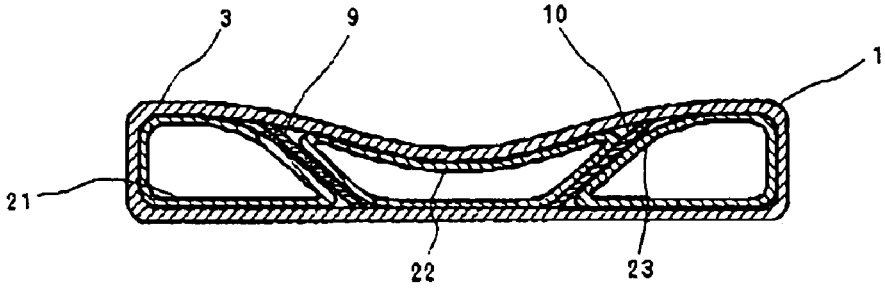
FIG. 5 is a sectional view taken along the line A—A of the pillow when a pressure is applied to the central portion.
Figure 6:
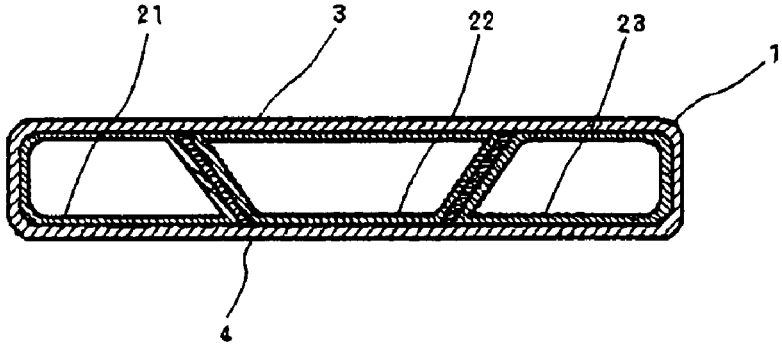
FIG. 6 is a sectional view taken along the line A—A of the pillow showing another embodiment of the shape of the unit stuffing material.
Figure 7:
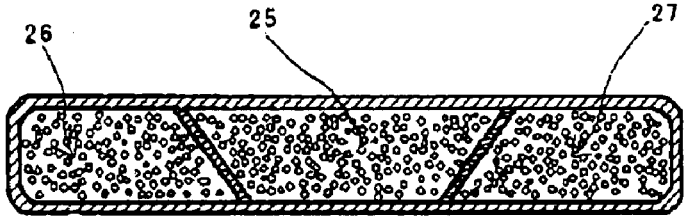
FIG. 7 is a sectional view taken along the line A—A of the pillow when using chipped stuffing materials as stuffing materials.
Figure 8:
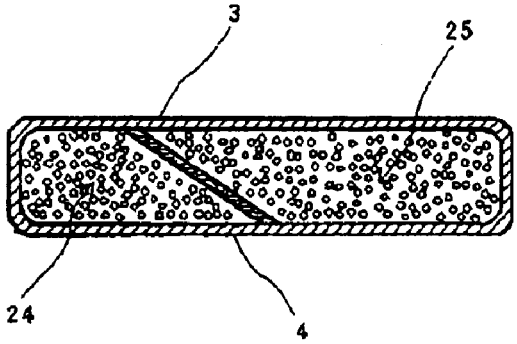
FIG. 8 is a sectional view taken along the line B—B of the same pillow.
Figure 9:
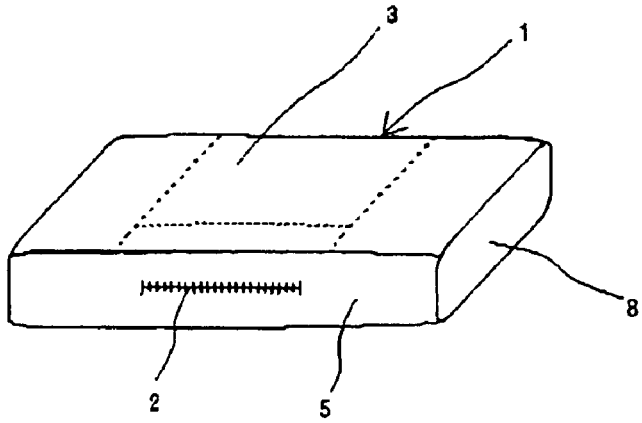
FIG. 9 is a perspective view of the appearance of the pillow according to the present invention.

As the stuffing material, there exist a chipped stuffing material shown as numerical symbols 24 to 27 in FIGS. 7 and 8 and a unit stuffing material shown as numerical symbols 20 to 23 in FIGS. 3 to 6. For chipped stuffing materials 24, 25, 26 and 27, feathers, floss, resin chips, wood chips including Japanese cypress, cushion materials, buckwheat husks, tea leaves, and the like, which are materials suitable for being filled into the pillow casing 1, are used. On the other hand, unit stuffing materials 20, 21, 22 and 23 consist of a bag with a certain volume into which chips such as feathers, floss, resin chips, wood chips including Japanese cypress, cushion materials, buckwheat husks, tea leaves, and the like are stuffed. Further, the unit stuffing material has a shape adapted to that of a partitioned section to be filled. While the unit stuffing materials 21, 22 and 23 which completely conform to the shapes of the partitioned sections as shown in FIG. 6 are preferable, those which approximately conform to them as shown in FIGS. 2 and 3 would be sufficient.

Figure 10:
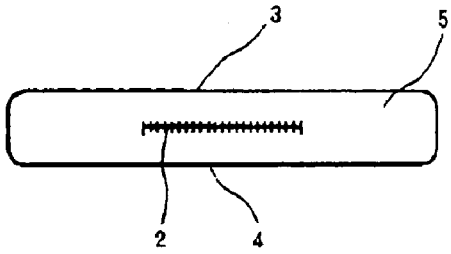
FIG. 10 is a rear view of the above.
Figure 11:
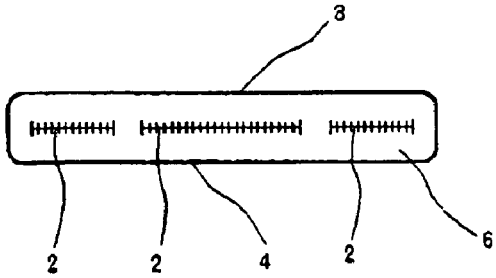
FIG. 11 is a front view of the above.

In the embodiment, the pillow casing 1 is a three-dimensionally sewn product made of cloth, and comprises top cloth 3, bottom cloth 4, front cloth 5, back cloth 6, side clothes 7 and 8, and partitions 9, 10 and 11 which are sewn to the inside the pillow casing 1. Further, a fastener 2 provided on the front cloth 5 and the back cloth 6 in FIGS. 9 to 11 is directed to forming an insertion opening through which the chipped stuffing materials or the unit stuffing materials are put into or taken out of the interior of a partitioned section inside the pillow casing 1. Through the insertion opening, the unit stuffing materials 20, 21, 22 and 23 or the chipped stuffing materials 24, 25, 26 and 27 are filled.

As the partition in the embodiment shown in FIGS. 1 to 11, there exist a left longitudinal partition 9 and a right longitudinal partition 10 provided in a longitudinal direction, i.e., a direction orthogonal to the lengthwise direction (transverse direction) of the pillow casing 1, and a central transverse partition 11 provided in a transverse direction between the left longitudinal partition 9 and the right longitudinal partition 10, which partition the inside of the pillow casing 1 into 5 sections.

Figure 12:
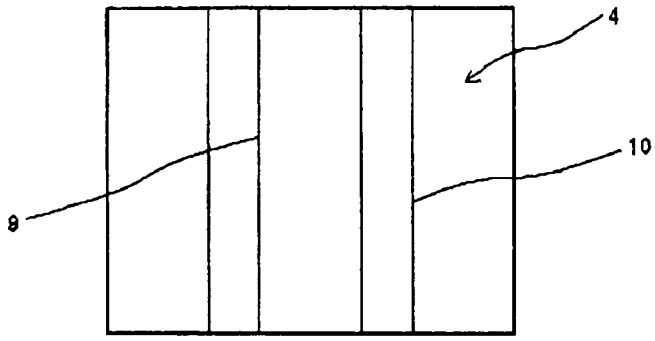
FIG. 12 is a plan view showing the second embodiment of the partition.
Figure 13:
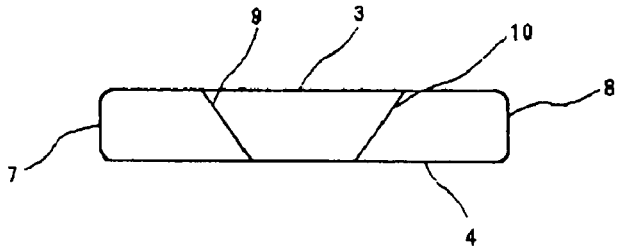
FIG. 13 is a front view of the above.
Figure 14:
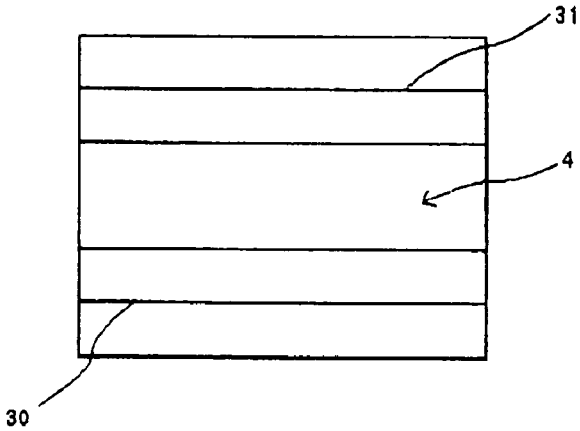
FIG. 14 is a plan view showing the third embodiment of the partition.
Figure 15:
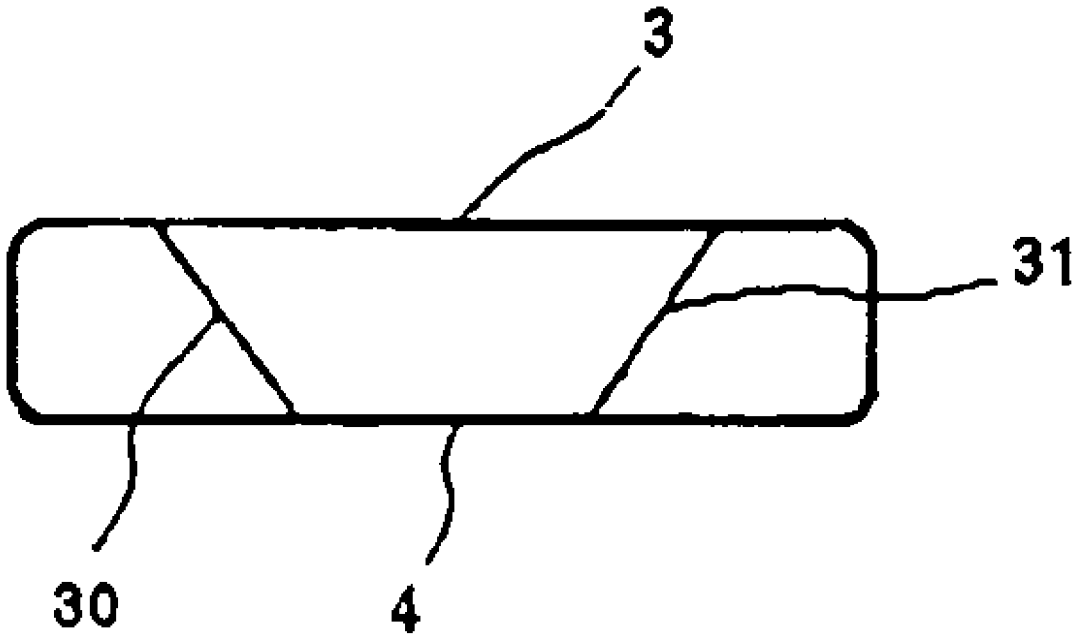
FIG. 15 is a right side view of the above.

However, as shown in FIGS. 12 and 13, the present invention includes a pillow having three sections made by two partitions of the left longitudinal partition 9 and the right longitudinal partition 10 provided in a direction orthogonal to the lengthwise direction (transverse direction) of the pillow casing 1 without providing the central transverse partition 11. Further, as shown in FIGS. 14 and 15, the present invention includes a pillow having three sections made by two transverse partitions of a front transverse partition 30 and a back transverse partition 31 provided in a direction parallel to the lengthwise direction (transverse direction) of the pillow casing 1.

The left longitudinal partition 9 and the right longitudinal partition 10 are pair of partitions which slopes in such a manner as to open upward (direction toward the top cloth 3), and each of the upper end is sewn to the top cloth 3 and each of the lower end is sewn to the bottom cloth 4. The partitions 9 and 10 may be attached by means of bonding using adhesive, etc. other than the sewing up. It should be added that both the partitions 9 and 10 are not necessarily sewn or bonded to the front cloth 5 and the back cloth 6.

The left longitudinal partition 9 and the right longitudinal partition 10 are each provided at an inclination of 45 degrees toward the outside. That is, the gradients of both the partitions 9 and 10 are 45 degrees. While the inclination is preferably 45 degrees, it may be within the range of 30 degrees to 60 degrees in accordance with properties of the stuffing materials.

Between the longitudinal partition 9 and the right longitudinal partition 10, there is provided in a direction orthogonal to both the longitudinal partitions 9 and 10 the central transverse partition 11 which slopes from the back side toward the front side (the side of the neck when using). The inclination of the central transverse partition 11 is preferably also 45 degrees.

What is claimed is:

1. A pillow characterized in that a plurality of sections are formed inside the pillow casing by providing in a direction orthogonal to the lengthwise direction of the pillow casing a pair of longitudinal partitions which slope in such a manner as to open upward between the top cloth and the bottom cloth of the pillow casing and providing in a direction orthogonal to the longitudinal partitions a transverse partition which slopes in one direction between the pair of longitudinal partitions, so that stuffing materials are filled into the sections.

* * * * *